US009130261B2

(12) United States Patent
Chang

(10) Patent No.: US 9,130,261 B2
(45) Date of Patent: Sep. 8, 2015

(54) INVERTED-F ANTENNA

(75) Inventor: Jin-Su Chang, Hsinchu County (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 168 days.

(21) Appl. No.: 13/277,294

(22) Filed: Oct. 20, 2011

(65) Prior Publication Data

US 2013/0009824 A1 Jan. 10, 2013

(30) Foreign Application Priority Data

Jul. 5, 2011 (TW) ..... 100123645 A

(51) Int. Cl.
*H01Q 1/24* (2006.01)
*H01Q 9/04* (2006.01)

(52) U.S. Cl.
CPC ..... *H01Q 9/0421* (2013.01)

(58) Field of Classification Search
USPC ..... 343/700 MS, 702, 770, 718, 846
See application file for complete search history.

(56) References Cited

U.S. PATENT DOCUMENTS 5,828,340 A * 10/1998 Johnson ..... 343/700 MS
5,926,139 A * 7/1999 Korisch ..... 343/702
6,157,344 A * 12/2000 Bateman et al. ..... 343/700 MS
6,774,849 B2 * 8/2004 Umehara et al. ..... 343/700 MS
6,861,986 B2 * 3/2005 Fang et al. ..... 343/700 MS
6,864,842 B2 * 3/2005 Hung et al. ..... 343/700 MS
6,917,334 B2 * 7/2005 Chen ..... 343/700 MS
7,136,022 B2 * 11/2006 Sato et al. ..... 343/702
7,589,692 B2 * 9/2009 Kim et al. ..... 343/846
2005/0174296 A1 * 8/2005 Okado ..... 343/795
2005/0259024 A1 * 11/2005 Hung et al. ..... 343/770

OTHER PUBLICATIONS

Jeen-Sheen Row, Dual-Frequency Triangular Planar Inverted-F Antenna, Feb. 2005, IEEE Transactions on Antennas and Propagation, vol. 53, pp. 874-876.*

J. I. Moon, D. U. Sim and S. O. Park, 'Compact PIFA for 2.4/5 GHz dual ISM-band applications', Jul. 8, 2004, Electronics Letters, vol. 40, No. 14.*

* cited by examiner

*Primary Examiner* — Hoang V Nguyen
*Assistant Examiner* — Hai Tran
(74) *Attorney, Agent, or Firm* — WPAT, P.C.; Justin King

(57) ABSTRACT

An improved inverted-F antenna, adapted for wireless communication devices, is disclosed, which comprises: a ground plane; a pin, coupled to a side of the ground plane while extending vertically upward therefrom; a first radiation unit, connected to an end of the pin that is not connected to the ground plane while enabling the periphery of the same to align with the periphery of the ground plane. Moreover, the inverted-F antenna is further comprised of: a second radiation unit, connected to the end of the first radiation unit that is not connected to the pin while enabling the same to be enveloped within the periphery of the ground plane, and being shaped like a fan tapering toward the end thereof that is connected to the first radiation unit; and a feed point, disposed extendingly from an end of the first radiation unit for feeding electrical signals.

8 Claims, 3 Drawing Sheets

INVERTED-F ANTENNA

FIELD OF THE INVENTION

The present invention relates to an improved inverted-F antenna, and more particularly, to a dual band antenna, composed of a ground plane, a pin, a first radiation unit, a second radiation unit and a feed point while using the first and the second radiation units for transceiving 2.4 GHz signals and 5 GHz signals in respective, and enabling the length of the pin to be in direction proportion with the size of the first radiation unit, and thereby, optimizing the dual-band signal transceiving ability of the aforesaid inverted-F antenna.

BACKGROUND OF THE INVENTION

With rapid advance in wireless communication technology, especially in the fields of cellular phone, global positioning system and wireless network, it is more than common nowadays for use to be able to use a notebook computer with Wi-Fi capability supporting IEEE 802.11 standard for connecting to Internet wirelessly at any public area. However, in order to enable a notebook computer to have the Wi-Fi capability, it is required for the notebook computer to be configured with an antenna at two sides of its top cover panel. Nevertheless, it is noted that the wireless signal transceiving ability and quality of the antenna, especially for 2.4 GHz signals, are directly dependent upon the shape of the antenna, and thus, it is in need of an improved inverted-F antenna.

SUMMARY OF THE INVENTION

In view of the disadvantages of prior art, the primary object of the present invention is to provide a dual band inverted-F antenna, composed of a ground plane, a pin, a first radiation unit, a second radiation unit and a feed point while using the first and the second radiation units for transceiving 2.4 GHz signals and 5 GHz signals in respective, and enabling the length of the pin to be in direction proportion with the size of the first radiation unit, and thereby, optimizing the dual-band signal transceiving ability of the aforesaid inverted-F antenna.

To achieve the above object, the present invention provides an improved inverted-F antenna, being adapted for wireless communication devices, which comprises: a ground plane; a pin, coupled to a side of the ground plane while extending vertically upward therefrom; a first radiation unit, connected to an end of the pin that is not connected to the ground plane while enabling the periphery of the same to almost align with the periphery of the ground plane, and thus forming a ⊓-shaped structure. Moreover, inverted-F antenna is further comprised of: a second radiation unit, connected to the end of the first radiation unit that is not connected to the pin while enabling the same to be enveloped within the periphery of the ground plane, and being shaped like a fan tapering toward the end thereof that is connected to the first radiation unit; and a feed point, disposed extendingly from an end of the first radiation unit for feeding electrical signals.

Preferably, the first radiation unit is coplanar arranged with the second radiation unit.

Preferably, the first radiation unit, the second radiation unit and the ground plane are disposed parallel to one another.

Preferably, the second radiation unit is formed like a trapezoid.

Preferably, the second radiation unit is bended toward the ground plane for enabling the free end of the second radiation unit that is not connected to the first radiation unit to extend toward the ground plane, and the impedance matching of the second radiation unit is capable of being adjusted according to the size of the bended area of the second radiation unit or the distance measured between the bended area of the second radiation unit and the ground plane.

Preferably, the included angle of the fan-like second radiation unit is formed ranged between 53 degrees and 90 degrees.

Preferably, the ground plane is substantially a metallic zone constructed on a printed circuit board.

Preferably, the first radiation unit is adapted for transceiving signals of a first band, and the second radiation unit is adapted for transceiving signals of a second frequency band, while the working frequency of the second band is higher than that of the first band.

Preferably, the electrical signal feeding of the feed point is performed in a means selected from the group consisting of: a coaxial cable means and a coplanar waveguide (CPW) means.

Preferably, the length of the pin is designed in direction proportion with the size of the first radiation unit, and consequently, since the resonance frequency between the ground plane and the first radiation unit is adjustable by adjusting the length of the pin, any working frequency that is considered suitable can be acquired by adjusting the size of the first radiation unit.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

Figure 1:
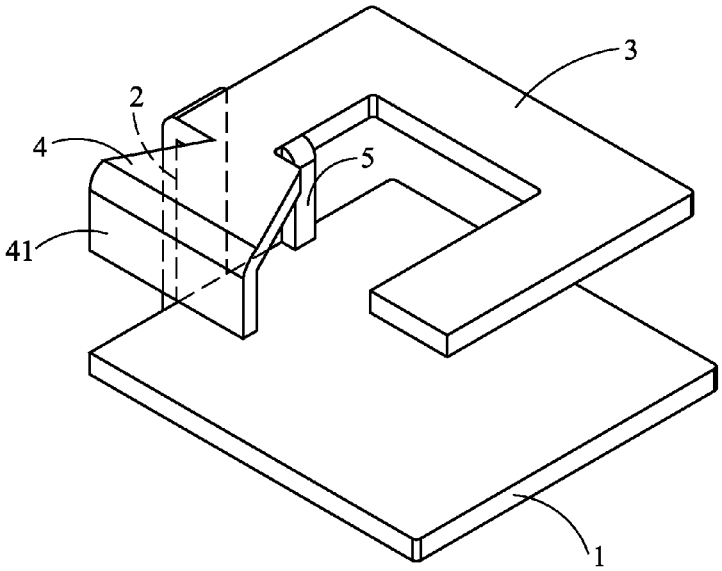
FIG. 1 to FIG. 4 are schematic diagrams of an inverted-F antenna according to the present invention that are viewed from various viewing angles.
Figure 2:
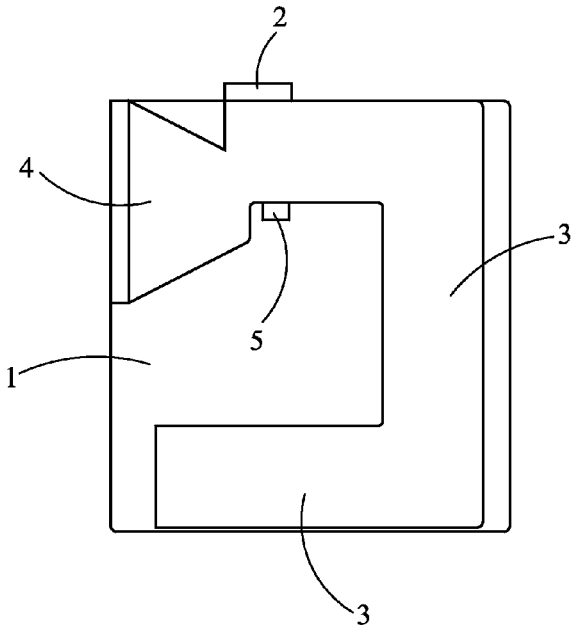
Figure 3:
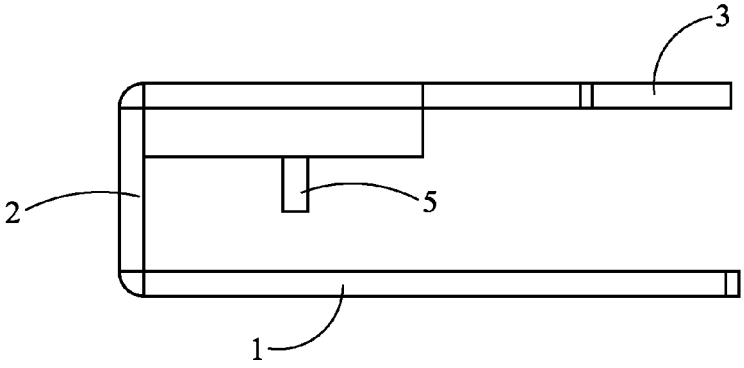
Figure 4:
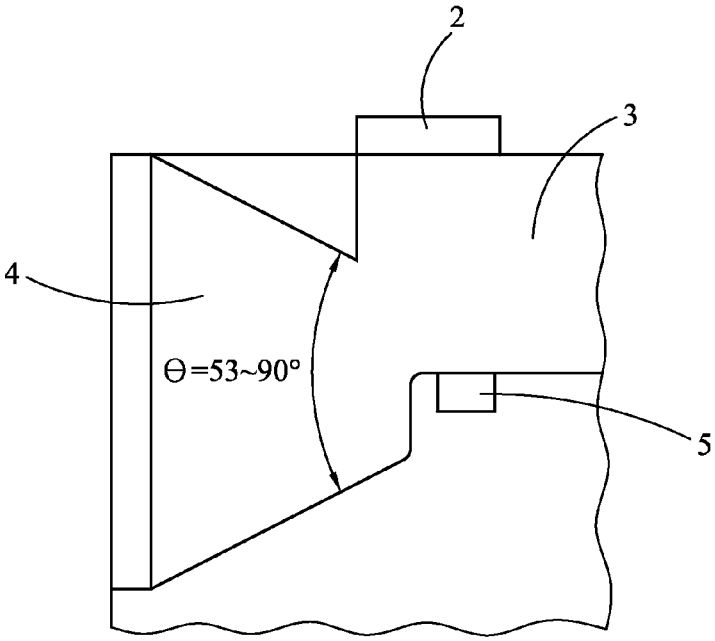

For your esteemed members of reviewing committee to further understand and recognize the fulfilled functions and structural characteristics of the invention, several exemplary embodiments cooperating with detailed description are presented as the follows.

Please refer to FIG. 1 to FIG. 4, which are schematic diagrams of an inverted-F antenna according to the present invention that are viewed from various viewing angles. As shown in FIG. 1 to FIG. 5, the inverted-F antenna, being adapted for wireless communication devices, comprises: a ground plane 1; a pin 2, coupled to a side of the ground plane 1 while extending vertically upward therefrom; a first radiation unit 3, connected to an end of the pin 2 that is not connected to the ground plane 1 while enabling the periphery of the same to about align with the periphery of the ground plane 1, and thus forming a ⊓-shaped structure. Moreover, inverted-F antenna is further comprised of: a second radiation unit 4, connected to the end of the first radiation unit that is not connected to the pin while enabling the same to be enveloped within the periphery of the ground plane 1, and being shaped like a trapezoid that is tapering toward the end thereof that is connected to the first radiation unit 3; and a feed point 5, disposed extendingly from an end of the first radiation unit 3 for feeding electrical signals. It is noted that the ground plane 1 can substantially be a metallic zone constructed on a printed circuit board, by that the inverted-F antenna of the present invention can be integrated directly with a printed circuit board. However, in the present embodiment, the ground plane 1 is a metal piece that is integrally formed with other portion of the inverted-F antenna. In addition, the second radiation unit 4 is bended toward the ground plane for enabling the free end of the second radiation unit 4 that is not connected to the first radiation unit to extend toward the ground plane, by that a bended portion 41 of the second radiation unit 4 is formed; and the included angle of the trapezoid-shaped second radiation unit 4 is formed ranged between 53 degrees and 90 degrees for enabling the resulting antenna to have appropriate frequency characteristics. Moreover, the electrical signal feeding of the feed point is performed in a means selected from the group consisting of: a coaxial cable means and a coplanar waveguide (CPW) means.

Particularly, while the inverted-F antenna of the present invention is adapted for transceiving 2.4 GHz signals and 5 GHz signals, the first radiation unit 3 is adapted for transceiving 2.4 GHZ signals and the second radiation unit 4 is adapted for transceiving 5 GHZ signals.

Preferably, the length of the pin 2 is designed in direction proportion with the size of the first radiation unit 3, and consequently, since the coupling effect is directly affected by the interval formed between the first radiation unit 3 and the ground plane 1, the impedance matching and frequency matching of the inverted-F antenna can be adjusted simply by adjusting the length of the pin in view of optimizing the performance of the antenna.

Figure 5:
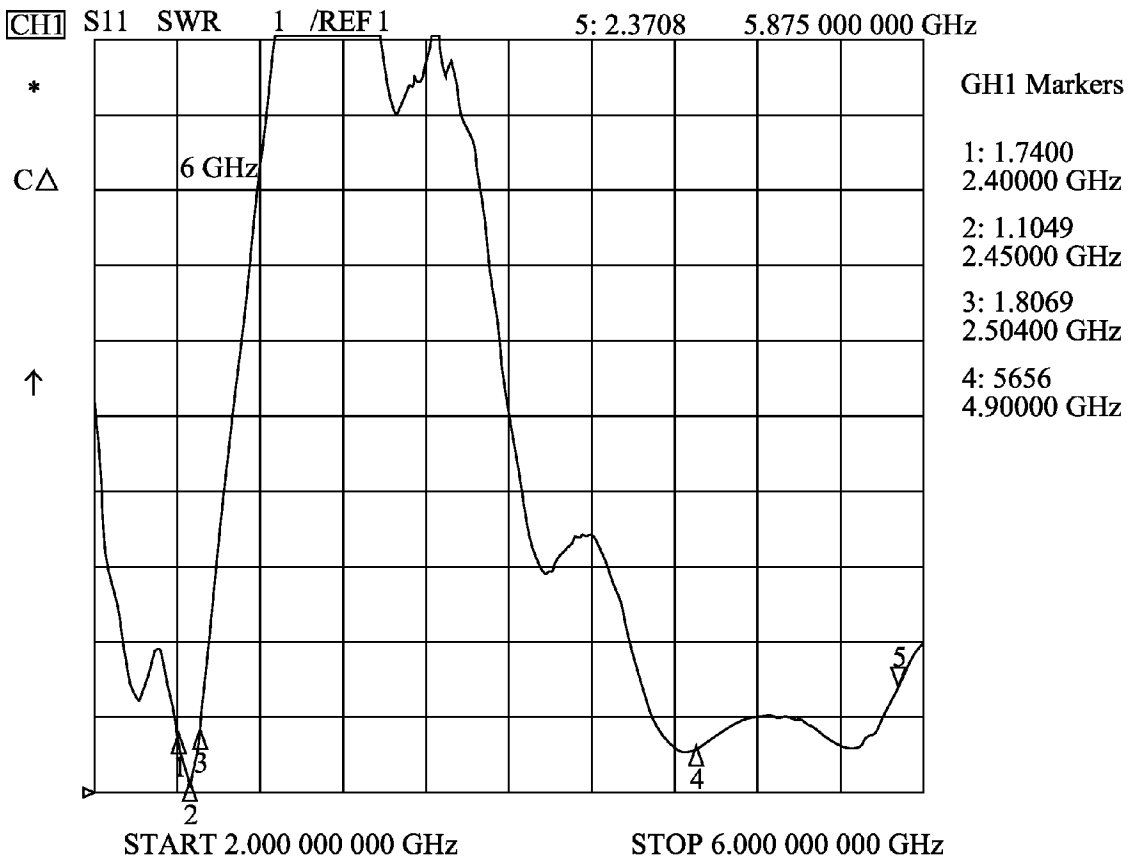
FIG. 5 is a schematic diagram showing a VSWR (voltage standing wave ratio) test result of an inverted-F antenna according to the present invention.

Please refer to FIG. 5, which is a schematic diagram showing a VSWR (voltage standing wave ratio) test result of an inverted-F antenna according to the present invention. From the test result shown in FIG. 5 where the Y axis represents the voltage standing wave ratio and the X axis represents the frequency, it is noted that the inverted-F antenna can perform satisfactory in the frequency band ranged between 2 GHz to 6 GHz, so that the inverted-F antenna can actually working as a dual band antenna.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. An improved inverted-F antenna, being adapted for wireless communication devices, comprising:

a ground plane;

a pin, wherein one end of the pin is coupled to a side of the ground plane while extending vertically upward therefrom;

a first radiation unit, being of a U shaped structure and connected to the other end of the pin and there is a space formed between the first radiation unit and the ground plane, and the first radiation unit's projection on a plane of the ground plane overlapping the ground plane;

a second radiation unit, being shaped like a trapezoid tapering toward the end thereof that is connected to the first radiation unit, and a direction of a tapering end of the second radiation unit being inverse to a direction of an opening of the first radiation unit, and the second radiation unit's projection on the plane of the ground plane overlapping the ground plane, wherein the other end of the second radiation unit not connecting to the first radiation unit is bent toward the ground plane, whereby one part of the second radiation unit is parallel to the ground plane and the first radiation unit, but the other part of the second radiation unit is perpendicular to the ground plane and the first radiation unit; and a periphery of the first radiation unit and a periphery of the second radiation unit do not exceed a periphery of the ground plane; and a feed point, disposed extendingly from an end of the first radiation unit for feeding electrical signals;

wherein, the first radiation unit is adapted for transceiving signals of a first band, and the second radiation unit is adapted for transceiving signals of a second frequency band, while the working frequency of the second band is higher than that of the first band.

2. The inverted-F antenna of claim 1, wherein the included angle of the fan-like second radiation unit is formed ranged between 53 degrees and 90 degrees.

3. The inverted-F antenna of claim 1, wherein the ground plane is substantially a metallic zone constructed on a printed circuit board.

4. The inverted-F antenna of claim 1, wherein while the inverted-F antenna is adapted for transceiving 2.4 GHz signals and 5 GHz signals, the first said radiation unit is adapted for transceiving 2.4 GHZ signals and the second radiation unit is adapted for transceiving 5 GHZ signals.

5. The inverted-F antenna of claim 1, wherein the electrical signal feeding of the feed point is performed in a means selected from the group consisting of: a coaxial cable means and a coplanar waveguide (CPW) means.

6. The inverted-F antenna of claim 1, wherein the first radiation unit is coplanar arranged with the second radiation unit.

7. The inverted-F antenna of claim 1, wherein the first radiation unit and the second radiation unit are disposed parallel to each other.

8. The inverted-F antenna of claim 1, wherein the first radiation unit and said ground plane are disposed parallel to each other.

* * * * *